US006079696A

United States Patent [19]

Bette

[11] Patent Number: 6,079,696

[45] Date of Patent: Jun. 27, 2000

[54] NON POWER TOOL FOR MOUNTING DOORS

[76] Inventor: James R Bette, 17935 Rosita St., Encino, Calif. 91316

[21] Appl. No.: 09/158,131

[22] Filed: Sep. 21, 1998

[51] Int. Cl.[7] ..... B66F 3/00

[52] U.S. Cl. ..... 254/131

[58] Field of Search ..... 254/131, 8 B, 254/120, DIG. 1, DIG. 4, 421, 84, 25, 26 R, 17

[56] References Cited

U.S. PATENT DOCUMENTS

| | | | |
|---|---|---|---|
| 2,879,030 | 3/1959 | Loretitsch | 254/26 R |
| 3,181,855 | 5/1965 | Willenbring | 254/120 |
| 4,157,810 | 6/1979 | Haller et al. | 254/131 |
| 5,814,842 | 9/1998 | Muldoon et al. | 254/131 |

*Primary Examiner*—Robert C. Watson

[57] ABSTRACT

A non power tool for facilitating the unassisted installation of heavy doors. The tool consists of a lever assembly (FIG. 1) and a rotatable fulcrum assembly (FIG. 2). The door mounting platform (18) end of lever (10) is placed under the approximate center of the door and by applying foot pressure to the foot rest (19) or opposite end of the lever a heavy door may be lifted off the ground to the exact height necessary to engage the door fasteners while being balanced vertically by one hand of the installer. By applying side pressure to the lever (10) while maintaining lift pressure, the door may be swung into the opening by rotating the fulcrum assembly (FIG. 2) around a turntable bearing (14) intermeshing the two parts of the hinge and allowing the installer to set the hinge pins in place with his free hand. A soft cushioning material (15) separates the tool from what may be a finished floor surface thereby eliminating the possibility of damage to the floor. A single installer can manage heavy, bulky doors unassisted with a reduced risk of injury to himself and surrounding furniture and fixtures.

2 Claims, 3 Drawing Sheets

LEVER ASSEMBLY

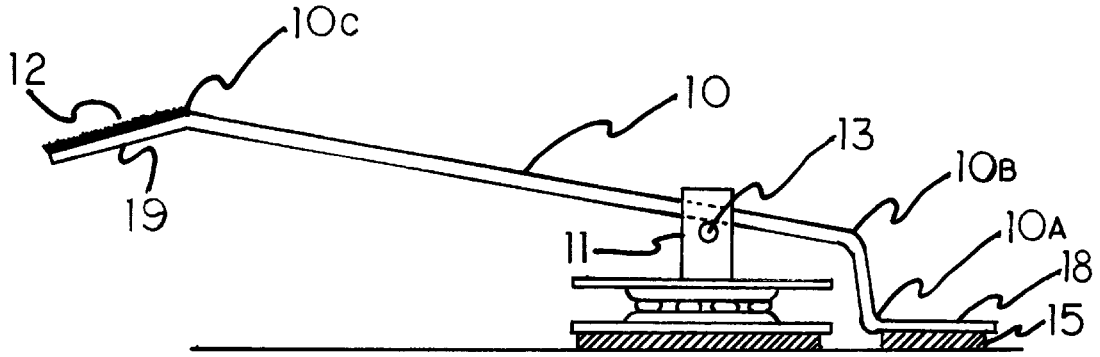
FIG. 1 LEVER ASSEMBLY
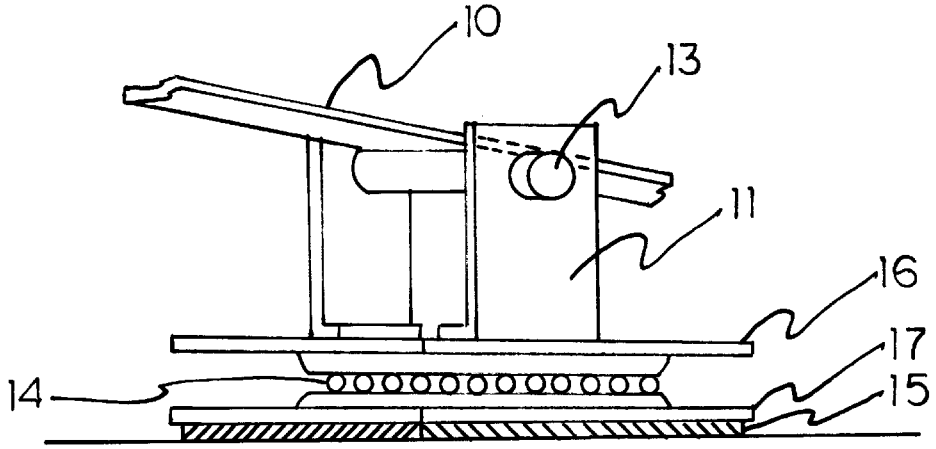
FIG. 2 FULCRUM ASSEMBLY

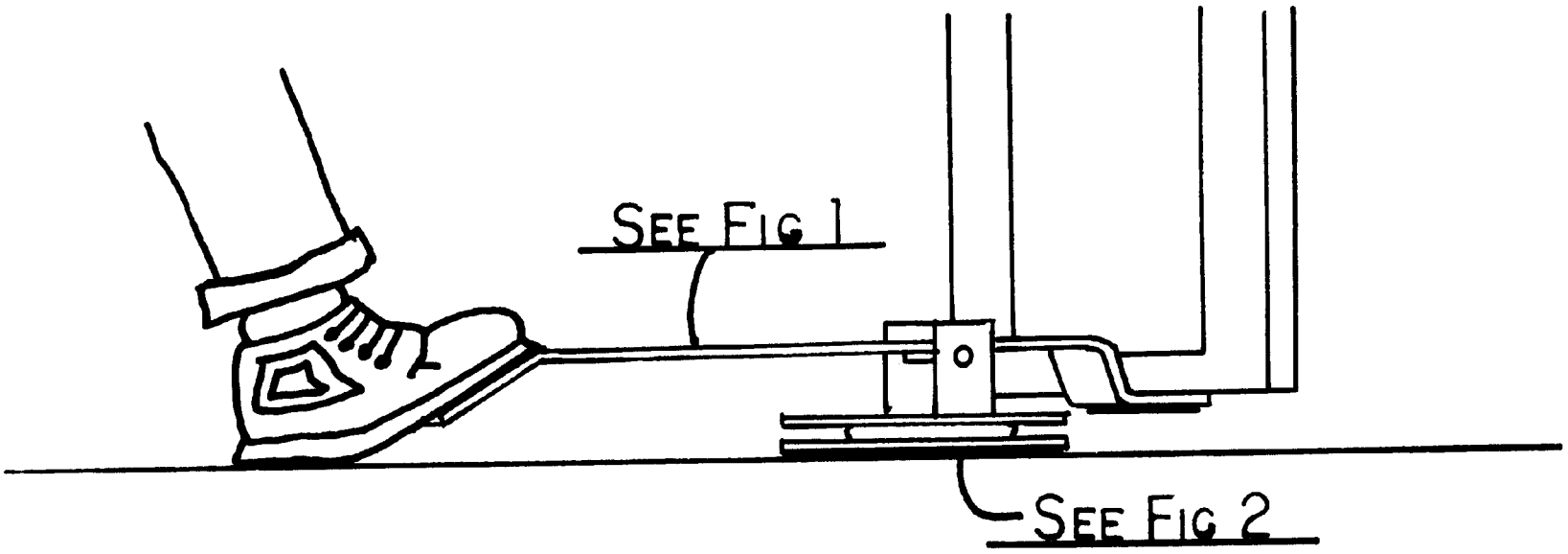
FIG 3 TOOL IN OPERATION

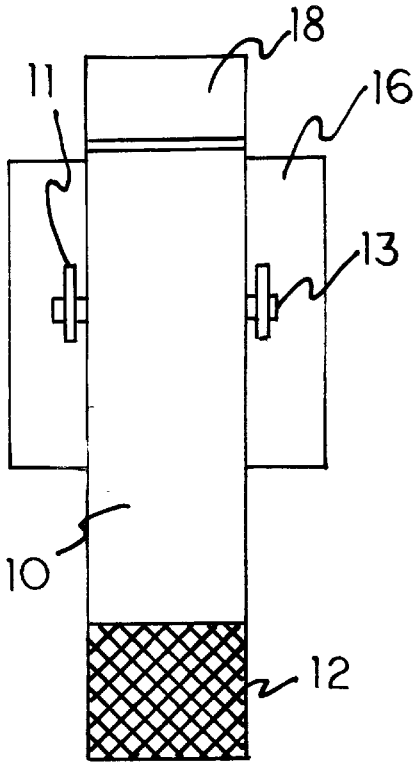
FIG.4A TOP VIEW
TOOL AT REST
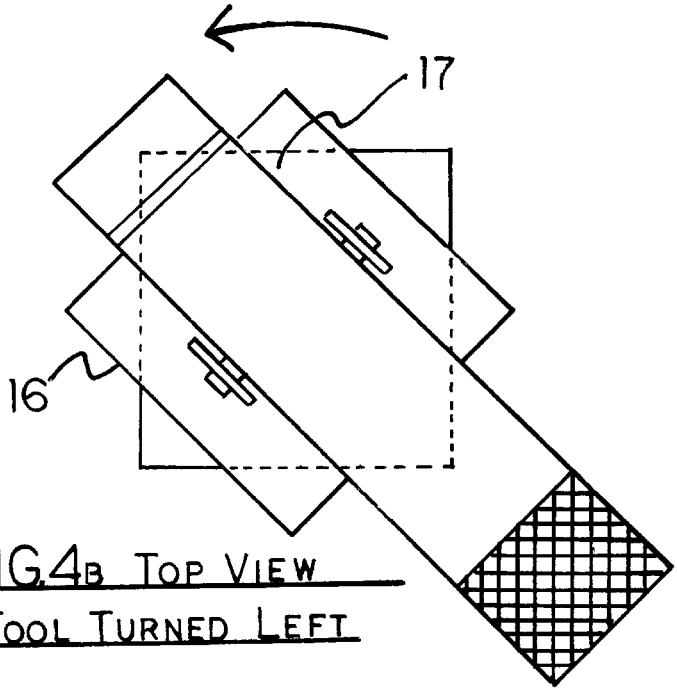
FIG.4B TOP VIEW
TOOL TURNED LEFT
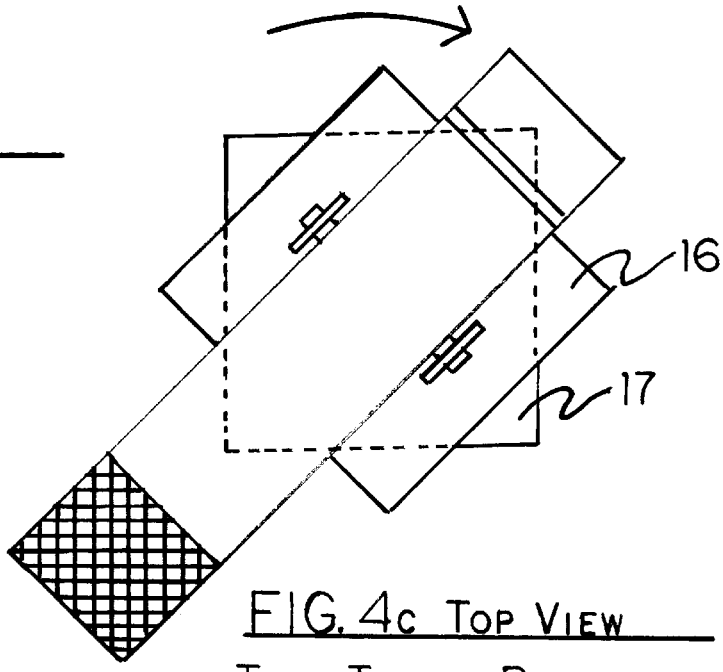
FIG. 4C TOP VIEW
TOOL TURNED RIGHT

NON POWER TOOL FOR MOUNTING DOORS

BACKGROUND OF THE INVENTION

In construction doors are installed in structures to restrict entry, separate offices, create fire barriers, separate heating/cooling zones, form sound barriers, protect occupied areas from the elements, form privacy barriers and for other reasons. These doors are usually made from wood or metal or a combination of the two and can be mounted on a track as are pocket doors or bi-fold doors or they can be mounted on pivot hinges fastened to the floor and head of a jamb allowing the door to swing freely in either direction (double acting) but by far the most common method of mounting doors in openings is by installing two or more simple mortise hinges made up of two halves or "leaves" joined in the center by a hinge pin.

Of the many tasks faced by contractors and carpenters, the installation of doors is one of the most complex requiring a high degree of skill. Specialized tools have been developed for door installers for efficiently fitting doors in openings including routers and hinge mortise jigs, door bucks, door lock mortising machines, portable planer/jointers, and elongated levels to name a few.

Doors can be purchased in a wide variety of shapes and sizes and an endless selection of styles but for the installer they generally fall into one of two categories: either they are "pre-hung" or they are not. A pre-hung door is purchased with the hinges already mortised in the jamb and door and represents a less complicated challenge for the installer since all that is required is to mount the jamb in the opening, plumb and level and the pre-fit door will operate freely. If the door is not pre-hung, the jamb and door are separate and the installers task is more complex since he now has to mount the jambs, mortise the door and the jamb to accept their respective parts of the hinge and then fit the door to the opening. All things being equal, pre-hung doors are more expensive to buy and less expensive to install where the reverse is true for doors that are not pre-hung. Whether the door is pre-hung or not, the most efficient method of mounting it in an opening is to remove the hinge pins and separate the door from the jamb, install the respective parts of the hinge on the door and on the jambs and then position the door in the opening and insert the hinge pins.

Once the jambs and the door have been fitted with their respective parts of the hinge the installer can now lift the door into the opening, mesh the two leaves of the hinge and insert the hinge pins thereby hanging the door. If it is a pre-hung door and the jambs were properly installed there should be little or no planing or sanding to achieve a properly fitted door in the opening. If it is not a pre-hung door, the installer may have to scribe the door to the jamb, remove it, plane and/or sand the door to the scribe mark, and then re-hang it. This procedure may have to be repeated several times before an acceptable fit is achieved.

Most contractors and carpenters who specialize in door installation usually work alone. They normally make a significant investment in tools and are reluctant to allows others to use them. Although there are some tasks that can be performed more efficiently by more than one worker, the occurrence of these tasks is only occasional, and the complexities of hiring, preparing payrolls, filing taxes, buying insurance, etc., for an employee usually outweigh any benefit.

Although most craftsmen would have great difficulty defining the the laws of physics they encounter while performing their trades, they are nevertheless adept at employing short cuts and techniques for managing heavy objects such as doors when working alone. By leaving one end of the door on the floor, the craftsman only has to lift half its weight. By "cornering" a door or balancing it on one of its corners, it can easily be turned completely around. By "walking" a door or alternately balancing it on the corners of one end while advancing the airborne end forward, the object can be moved short distances with minimal effort. However, once the jambs have been plumbed and leveled and the hinges positioned, the installer must lift the entire weight of the door to complete the installation.

The height the installer must lift the door is usually less than two inches. Doors are made to fit close to the floor and only need clearance for rugs, weather stripping, thresholds, sills, etc however, exterior doors, fire rated doors, and custom doors of infinite variety can weight well over 100 pounds and the installer must maneuver the door with enough precision to lift the door to the desired height, interlock the two parts of the hinge and hold it steady while using one hand to insert the hinge pins. It is at this critical point, while lifting and holding this large object upright, that damage to the door, jamb, floor or any furniture and fixtures in close proximity, can occur from dropping the door. As previously stated, in the case of a door that is not pre-hung, the installer may have to repeat the process of placing the door on its hinges several times before an acceptable fit is achieved. Because of the bulk of some doors, two and even three men may be required to lift the door, engage the the leaves of the hinge, and insert the hinge pins. When the door is mounted for a fit and must be planed or sanded or cut for a proper fit, the same effort is required for dismounting the door, that is, lifting the door to remove the weight from binding the pins, removing the pins, and disengaging the leaves of the hinges before removing the door to a work station.

Since there is no tool currently in use to assist the craftsman when performing this task, each individual uses different aids to achieve the desired results. These include placing simple pry bars, shims, or the installers foot or fingers under the door to lift the door to the desired height and/or to take up some of the weight of the door while the pins are being set. As noted before this can lead to injury to the installer such as bruised fingers and toes, muscle strain, hernia and rupture to name a few. In the case where a replacement door is being installed above a finished floor, crude tools can mar, scratch, tear, rip or dent a finished floor surface. In other cases one or more assistants may be required to mount the door.

BRIEF SUMMARY OF THE INVENTION

This invention relates to a tool which facilitates the installation of doors. Accordingly, several objects and advantages of this invention are:

(a) to provide a means whereby an installer can set in place even very heavy doors with a reduced likelihood of injury.

(b) to provide a means whereby an installer can set in place even very heavy doors, unassisted.

(c) to provide a means whereby an installer can set in place even very heavy doors with a reduced risk of damage.

(d) to provide a means whereby an installer can set in place even very heavy doors without damaging the floor surface.

BRIEF DESCRIPTION OF THE SEVERAL VIEWS OF THE DRAWING

FIG. 1 Lever Assembly

FIG. 2 Fulcrum Assembly

FIG. 3 Tool in Operation

FIG. 4*a* Tool at rest

FIG. 4*b* Tool turned left

FIG. 4*c* Tool turned right

REFERENCE NUMERALS IN DRAWINGS

10 lever
10*a* bend for lever platform
10*b* bend for fulcrum assembly clearance
10*c* bend for foot rest
11 strut
12 non-slip surface
13 metal dowel
14 turntable bearing
15 cushion
16 top metal bearing platform
17 bottom metal bearing platform
18 Lever platform
19 Foot rest

DETAILED DESCRIPTION OF THE INVENTION

A typical embodiment of the invention is shown in FIG. 1, (side view). The various parts of the tool can be made from steel, aluminum, or some other composite material or a combination of materials and may be held together by welds, rivets, screws, nuts and bolts, etc., but because welded steel components represent the most likely choice for reasons of strength and economy, for mass producing the tool, this embodiment will describe components made from mild steel and generally welded together. The tool operates on the principle of a lever and fulcrum where a lever 10 which is approximately 2 inches wide and 18 inches long is made from ¼ inch steel plate welded to metal dowel 13 loosely held in place by two metal ⅛ inch thick and one inch wide flat plate struts, pylons or supports 11 which allows lever 10 to rotate freely around an axis formed by metal dowel 13. Lever 10 is bent or formed at several locations so that at one end 10*a* it forms a thin platform 18 on which a door may be placed and at a second location 10*b* to give sufficient clearance to span over the fulcrum assembly and at another location 10*c* to provide a foot rest 19. Foot rest 19 is roughened with a grinder or stamped or fitted with a non-slip material such as stair tread tape or a pebble or sand embedded coating 12. 1½ inch high metal struts 11 are punched or drilled with holes of a slightly larger diameter than ¼ inch metal dowel 13 which extends fully through the strut hole and thus allows lever 10 to pivot freely in an up and down direction. Metal struts 11 are bent at the bottom where they are then welded to a top metal bearing platform 16 also made from ⅛ inch flat plate 3 inches square. Top metal bearing platform 16 receives the weight of objects lifted by lever 10 and helps to distribute the loads evenly to a turntable bearing 14 to which it is welded. Turntable bearing 14 is a common bearing used in several types of cabinetry and is available from several suppliers. It consists of a metal top flange and an identical bottom flange which are swaged together around a series of ball bearings. This configuration allows both halves of the bearing to move or rotate independently of the other. Turntable bearing 14 is then welded to a bottom metal bearing platform 17 which is identical to top metal bearing platform 16 and which performs a similar function i.e., distributing load stresses more evenly and also protecting the bearing from damage by being positioned over uneven surfaces and foreign objects. The under side of bottom metal bearing platform 17 and lever platform 18 are then fitted with a neoprene or EPDM or some other similar rubberized gasket material 15 that forms a soft cushion between the tool and what may be a finished floor surface such as hardwood, tile, rug, etc. This cushioned material can be applied with contact cement, urethane or some other adhesive.

In the drawings parts referred to as 10,10*a*,10*b*,10*c*,12, 15,18, and 19 are components of the lever assembly and parts referred to as 11,13,14,15,16,17 are components of the fulcrum assembly.

A contractor or carpenter or others familiar with the trade can make use of the tool when installing a door in an opening. Once the jamb and door have been fitted with their respective parts of the hinges, the door is positioned upright several inches from the jamb and tipped up on end. The thin platform end of the lever 10*a* is placed under the approximate center of the door and the door is rested on it. The installer then applies pressure to the opposite end of the lever 10*c* engaging the non-slip surface 12 with the sole of one foot, the heel of the same foot may rest on the floor to help the installer maintain his balance and while steadying the door from tipping with one hand, he raises the door to the approximate height where the opposing members of the hinges will intermesh. It is at this point that the entire door and tool assembly is separated from what may be a finished floor surface by the cushioned gasket material 15. The installer now applies side pressure to the lever with his foot while maintaining lift pressure rotating the upper half of the ball bearing turntable 14 the lever assembly and the door while the bottom half remains stationary, until both halves of the hinge are engaged. As the hinge parts begin to mesh, minor adjustments in height alignment can be made by increasing or decreasing foot pressure as well as vertical alignment by pivoting the door on the lever platform with the installers hand. Minor alignment errors of the opposing hinge parts can be corrected by tapping the misaligned hinge parts with a hammer with the installers free hand. Once the hinge parts interlock, the installer can insert the hinge pin with his free hand. This procedure is repeated until all hinge pins have been set.

In the case where further planing, cutting or sanding of the door is necessary, the tool is also very helpful to the installer when dismounting the door from its hinges. After marking the door in the area needing further adjustment(s) the tool is repositioned under the approximate center of the door, foot pressure is applied to the end of the lever 12 unbinding the hinge pins for removal and with side pressure as well as vertical pressure applied to the lever assembly, the door can safely be swung away from the jamb, unassisted and without marking the finished floor surface beneath it where it can be rested for removal to a work station.

Accordingly, the reader can see that by using this tool the installer enjoys much greater ease by lifting even very heavy doors with only slight foot pressure. The installer also enjoys greater control of large and bulky doors and the likelihood of dropping a door or of having a door fall down on furnishings or damaging interior finishes is also greatly diminished. Injury to the installer such as bruised fingers, bruised toes and feet, muscle and back strain and rupture of vital organs or hernia can be avoided through the use of this tool. In the case of replacement doors, the cushioned tool promises to leave finished floor surfaces intact and unmarked.

Although the description above contains many specificities, these should not be construed as limiting the scope of the invention but merely providing illustrations of some of the presently preferred embodiments of this invention. Thus the scope of the invention should be determined by the appended claims and their legal equivalents, rather than by the examples given.

What I claim as my invention is:

1. A manually operated tool for mounting doors into position so that one or more hinge leaves on a door can engage a one or more complimentary hinge leaves on a door jamb, said tool comprising:

a lever constructed and arranged so that when one end is placed under the door the other end can be elevated, whereby lowering said other end causes said one end to be lifted and the door raised, means mounting said lever for rotation about a horizontal axis so that said one end can be lowered and said other end simultaneously raised, and vice versa, and means mounting said tool for rotation about a vertical axis so that said lever can pivot a door into position while it is elevated to move said one or more hinge leaves on the door into alignment with said one or more complimentary hinge leaves on the door jamb, whereby a single operator can move a door into position with his foot and then fasten the interengaged hinge leaves to each other by hand.

2. A manually operated tool for positioning a door as set forth in claim 1 in which said lever is a flat bar, said one end deformed upwardly so that it can be positioned under a door when said one end is lowered, and said other end is deformed in the opposite direction from said other end to provide a pedal for the operator to depress with his toe while keeping the heel of his foot rested on the floor, thereby maintaining his balance.

* * * * *